US006633130B2

(12) United States Patent
Bae

(10) Patent No.: US 6,633,130 B2
(45) Date of Patent: Oct. 14, 2003

(54) COOLING SYSTEM OF LIGHTING APPARATUS USING MICROWAVE ENERGY

(75) Inventor: Young-Jin Bae, Daegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/122,708

(22) Filed: Apr. 12, 2002

(65) Prior Publication Data

US 2003/0168987 A1 Sep. 11, 2003

(30) Foreign Application Priority Data

Mar. 6, 2002 (KR) ..... 10-2002-0011966

(51) Int. Cl.[7] ..... H01J 7/46
(52) U.S. Cl. ..... 315/39; 313/45
(58) Field of Search ..... 315/5, 3.5, 39, 315/248, 267, 344, 111; 313/44, 634; 331/78, 126

(56) References Cited

U.S. PATENT DOCUMENTS 3,814,983 A * 6/1974 Weissfloch et al. ..... 315/39
3,911,318 A * 10/1975 Spero et al. ..... 315/39
4,695,757 A * 9/1987 Ury et al. ..... 313/44
5,866,990 A 2/1999 Ury et al. ..... 315/248
6,351,070 B1 * 2/2002 Barry ..... 315/39

* cited by examiner

*Primary Examiner*—Don Wong
*Assistant Examiner*—Jimmy T. Vu
(74) *Attorney, Agent, or Firm*—Ostrolenk, Faber, Gerb & Soffen, LLP

(57) ABSTRACT

In a lighting apparatus using microwave energy including a magnetron for generating microwave energy, a bulb for generating lights by the microwave energy, a wave guide for connecting the magnetron and the bulb and transmitting the microwave energy generated in the magnetron to the bulb and a casing housing the magnetron and the wave guide and combining with the bulb, a cooling system of a lighting apparatus using microwave energy comprises a heat exchanger installed to the exterior of a magnetron and having a coolant path, a radiating unit installed to the exterior of a casing and radiating heat of the coolant heated while passing the path of the heat exchanger, and a flow generating means installed between an outlet of the radiating unit and an inlet of the heat exchanger in order to make the coolant circulate the heat exchanger and the radiating unit.

16 Claims, 9 Drawing Sheets

COOLING SYSTEM OF LIGHTING APPARATUS USING MICROWAVE ENERGY

BACKGROUND OF THE INVENTION

1. Field of the Invention

The present invention relates to a cooling system of a lighting apparatus using microwave energy.

2. Description of the Prior Art

A lighting apparatus using microwave energy emits visible rays or ultraviolet rays by applying microwave energy to an electrodeless plasma lamp, it has longer life-span and shows better lighting efficiency than that of an incandescent lamp and a fluorescent lamp.

FIG. 1 is a longitudinal sectional view illustrating a lighting apparatus using microwave energy in accordance with the conventional art.

As depicted in FIG. 1, the conventional lighting apparatus using microwave energy includes a magnetron 2 installed inside a casing and generating microwave energy, a high voltage generator 3 boosting the voltage of utility AC power and supplying it to the magnetron 2, a wave guide 4 connected to an outlet of the magnetron 2 and transmitting microwave energy generated in the magnetron 2, a bulb 5 generating a light by using enclosed luminous materials in a plasma state by receiving the microwave energy transmitted through the wave guide 4, a resonator 6 covering the front portion of the bulb 5 in order to cut off the microwave energy and pass the light emitted from the bulb 5, a reflector 7 receiving the resonator 6 and focus-reflecting the light generated in the bulb 5 straightly, a dielectric mirror 8 installed inside the resonator 6 at the rear of the bulb 5 in order to pass the microwave energy and reflect the light, and a cooling fan assembly 9 placed at the side of the casing 1 and cooling the magnetron 2 and the high voltage generator 3.

The bulb 5 is constructed with a luminous unit 5*a* made of quartz and ceramic and having enclosed luminous materials in order to emit lights by being excited by microwave energy and an axial unit 5*b* combined with the luminous unit 5*a* by welding and extended toward inside the casing 1.

In addition, the bulb 5 cools high heat generated at the luminous unit 5*a* by being rotated according to a bulb motor 10.

In the meantime, in the conventional lighting apparatus using microwave energy, the magnetron 2 generates microwave energy according to a power apply, the microwave energy generated in the magnetron 2 excites the luminous unit 5*a* of the bulb 5 after passing the wave guide 4 and the resonator 6, and the luminous unit 5*a* generates lights. The lights generated in the luminous unit 5*a* are reflected by the reflector 7, accordingly a lighting function can be performed.

However, in the operation of the conventional lighting apparatus using microwave energy, lots of heat is generated at the magnetron 2, the wave guide 4 and the high voltage generator 3, etc., as depicted in FIG. 1, the magnetron, etc. are cooled by sucking external air into the casing 1 by using the cooling fan assembly 9.

However, because the lighting apparatus can be used at outdoors as well as indoors, in an air cooling type using a cooling fan in order to cool a heat generating unit of the lighting apparatus using microwave energy, impurities such as bugs, dusts, etc. or rain may come into, accordingly the apparatus may be damaged or a life-span of the apparatus may be lowered.

Particularly, if a quantity of a lighting apparatus is increased in order to improve a brightness, heat generated inside the apparatus has to be discharged more efficiently.

SUMMARY OF THE INVENTION

In order to solve the above-mentioned problems, it is an object of the present invention to provide a lighting apparatus using microwave energy which is capable of discharging heat generated inside the apparatus to outside more efficiently and having a sealed cooling structure preventable penetration of external impurities by installing a heat exchanger having a coolant path to the exterior of internal heat generating units.

In order to achieve the above-mentioned object, in a lighting apparatus using microwave energy including a magnetron for generating microwave energy, a bulb for generating lights by the microwave energy, a wave guide for connecting the magnetron and the bulb and transmitting the microwave energy generated in the magnetron to the bulb and a casing housing the magnetron and the wave guide and combining with the bulb, a cooling system of a lighting apparatus using microwave energy comprises a heat exchanger installed to the exterior of a magnetron and having a coolant path, a radiating unit installed to the exterior of the casing and radiating heat of the coolant heated while passing the coolant path of the heat exchanger, and a flow generating means installed between an outlet of the radiating unit and an inlet of the heat exchanger in order to make the coolant circulate the heat exchanger and the radiating unit.

In a lighting apparatus using microwave energy including a magnetron for generating microwave energy, a bulb for generating lights by the microwave energy, a wave guide for connecting the magnetron and the bulb and transmitting the microwave energy generated in the magnetron to the bulb and a casing housing the magnetron and the wave guide inside and combining with the bulb, a cooling system of a lighting apparatus using microwave energy comprises a heat exchanger installed to the exterior of internal heat generating units of the lighting apparatus and having a coolant path, a radiating unit installed to the exterior of a casing and radiating heat of a coolant heated while passing the coolant path of the heat exchanger, and a flow generating means installed between an outlet of the radiating unit and an inlet of the heat exchanger in order to make the coolant circulate the heat exchanger and the radiating unit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, a cooling system of a lighting apparatus using microwave energy in accordance with the present invention will be described in detail with reference to accompanying drawings.

Figure 1:
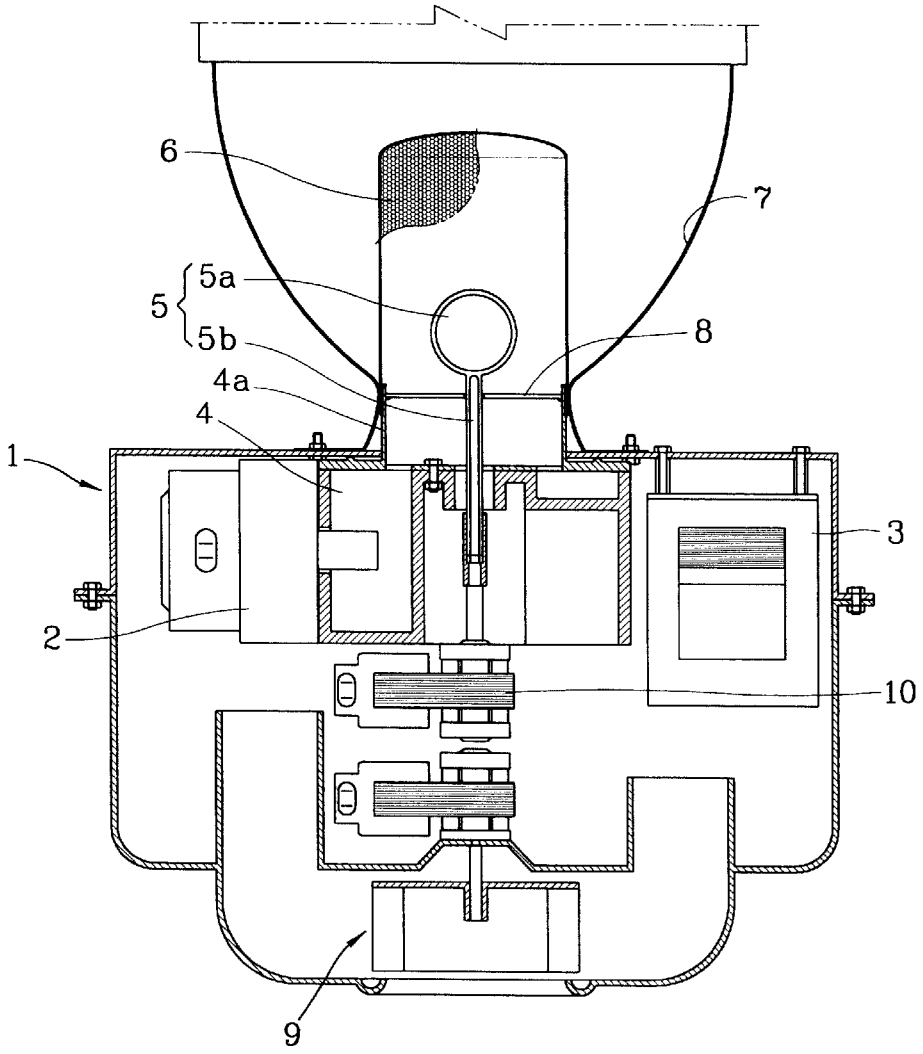
FIG. 1 BACKGROUND ART
FIG. 1 is a longitudinal sectional view illustrating a lighting apparatus using microwave energy in accordance with the conventional art.
Figure 2:
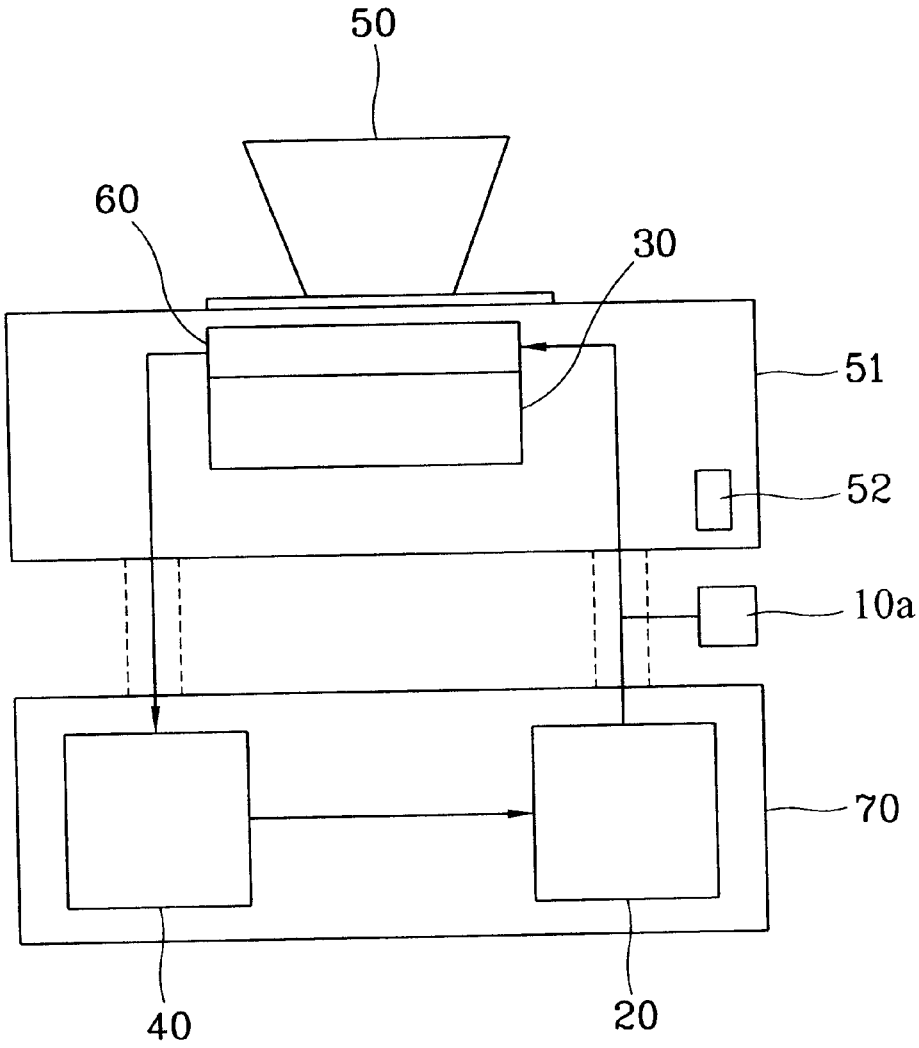
FIG. 2 is a conceptual view illustrating a cooling system of a lighting apparatus using microwave energy in accordance with the present invention.
Figure 3:
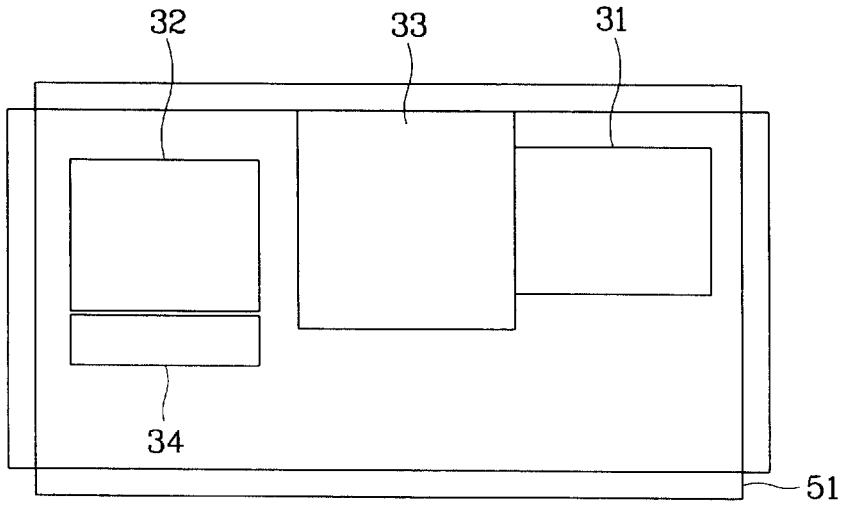
FIG. 3 is a conceptual view illustrating internal heat generating units of the lighting apparatus using microwave energy in accordance with the present invention.

FIG. 2 is a conceptual view illustrating a cooling system of a lighting apparatus using microwave energy in accordance with the present invention, and FIG. 3 is a conceptual view illustrating internal heat generating units of the lighting apparatus using microwave energy in accordance with the present invention.

As depicted in FIG. 2, in a lighting apparatus using microwave energy having a bulb 50 and an internal heat generating unit 30 inside a casing 51, a cooling system of a lighting apparatus using microwave energy in accordance with the present invention includes a heat exchanger 60 installed to the exterior of the internal heat generating unit 30 and having a coolant path, a radiating unit 40 installed to the exterior of the casing 51 and radiating heat of the coolant heated while passing the coolant path of the heat exchanger 60, and a flow generating means 10*a* installed between an outlet of the radiating unit 40 and an inlet of the heat exchanger 60 in order to make the coolant circulate the heat exchanger 60 and the radiating unit 40.

As depicted in FIG. 3, the lighting apparatus using microwave energy includes a magnetron 31 generating microwave energy, a wave guide 33 connecting the magnetron 31 and the bulb 50 and transmitting microwave energy generated in the magnetron 31 to the bulb 50, and a casing 51 housing the magnetron 31 and the wave guide 33 and combining with the bulb 50.

In addition, the lighting apparatus can include a high voltage generator 32 and a condenser 34, etc. in case of need.

Particularly, as depicted in FIG. 3, the lighting apparatus includes internal heat generating units 30 such as the magnetron 31, the wave guide 33, the high voltage generator 32 for applying power to the magnetron 31 and a condenser 34, etc. Because they generate lots of heat in operation of the lighting apparatus, they have a temperature not less than 100° C. in operation, herein in the order of heating value the magnetron 31 is a first, the high voltage generator 32 is a second, and the condenser 34 is a third.

Accordingly, in the operation of the lighting apparatus, in order to secure stability and life-span of internal construction parts, heat generated in the internal heat generating units 30 has to be emitted, in other words, the internal heat generating units 30 have to be cooled.

Figure 4:
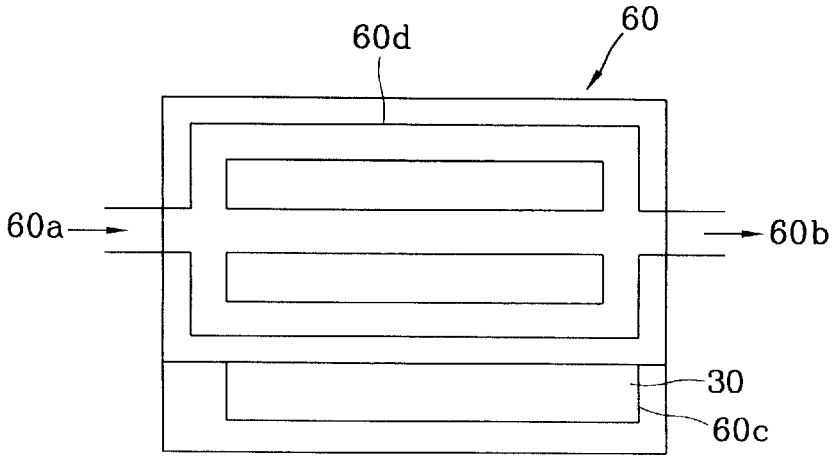
FIG. 4 is a conceptual view illustrating a heat exchanger of the lighting apparatus using microwave energy in accordance with the present invention.

FIG. 4 is a conceptual view illustrating a heat exchanger of the lighting apparatus using microwave energy in accordance with the present invention.

As depicted in FIG. 4, the heat exchanger 60 includes a receiving unit 60*c* for receiving the internal heat generating units 30, a plurality of coolant paths 60*d,* herein an inlet hole 60*a* for an inflow of a coolant is formed at the end of the coolant path 60*d,* and an outlet hole 60*d* for discharging a coolant is formed at the other end of the coolant path 60*b.* The heat exchanger 60 can be variously constructed according to a shape of the internal heat generating units 30.

Figure 5A:
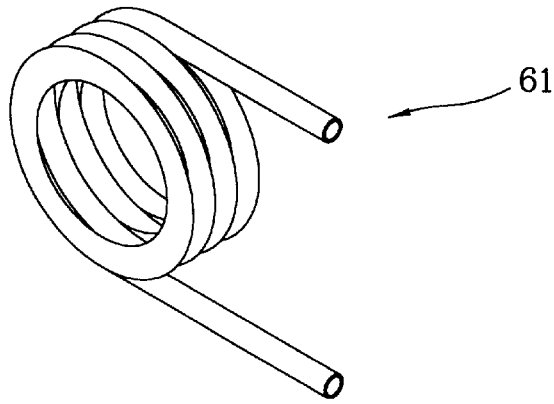
FIGS. 5*a,* 5*b* and 5*c* illustrate embodiments of a heat exchanger installed to a magnetron as a coil shape in a cooling system of the lighting apparatus using microwave energy in accordance with the present invention.
Figure 5B:
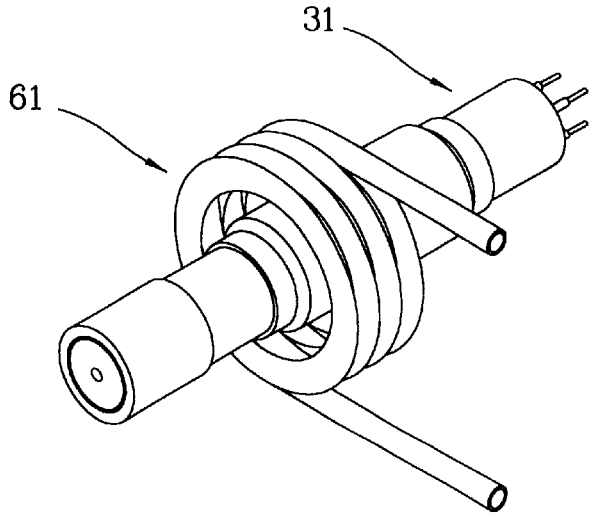
Figure 5C:
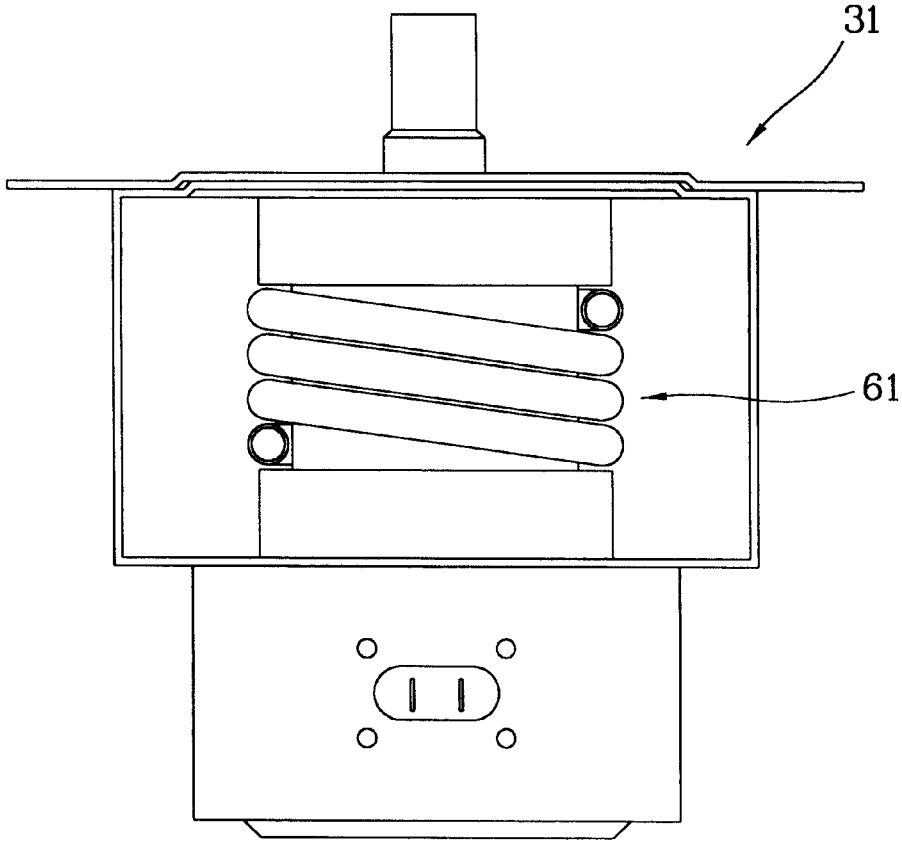
Figure 6A:
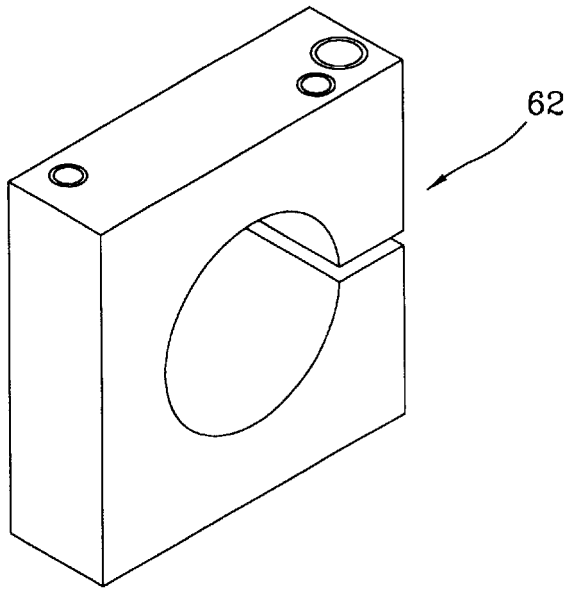
FIGS. 6*a,* 6*b* and 6*c* illustrate embodiments of a heat exchanger installed to a magnetron as a box shape in a cooling system of the lighting apparatus using microwave energy in accordance with the present invention.
Figure 6B:
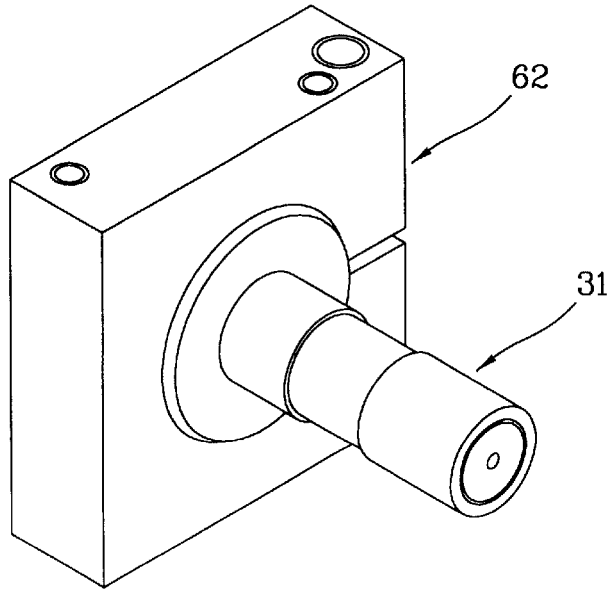
Figure 6C:
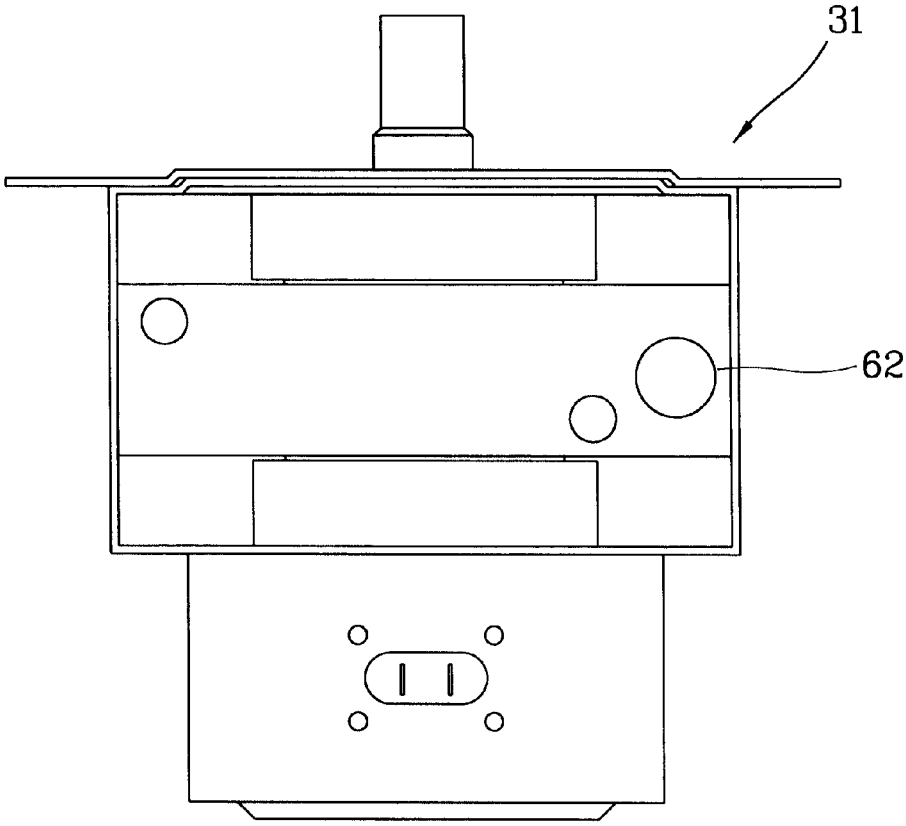
Figure 7:
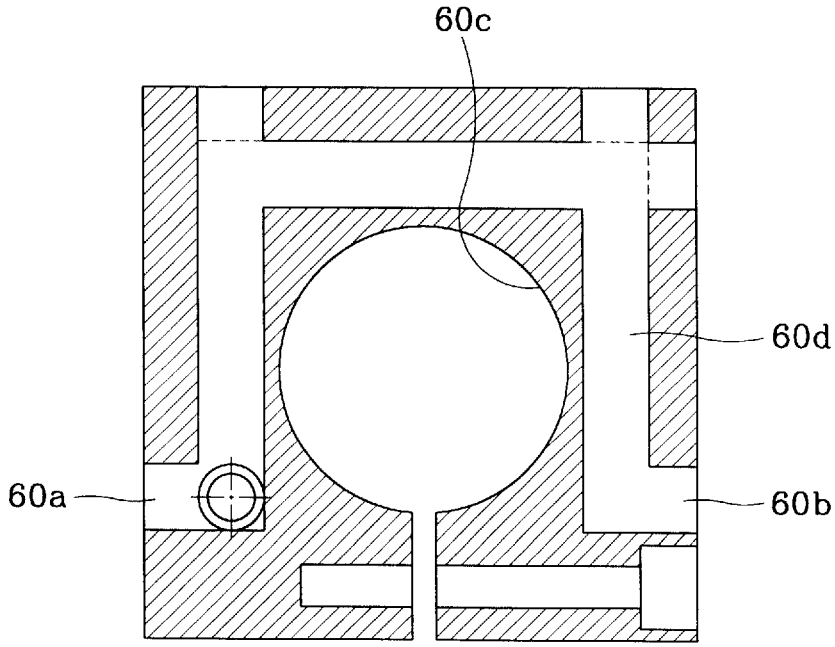
FIG. 7 is a sectional view of FIG. 6*a;*

FIGS. 5*a,* 5*b* and 5*c* illustrate embodiments of a heat exchanger installed to a magnetron as a coil shape in a cooling system of the lighting apparatus using microwave energy in accordance with the present invention. FIGS. 6*a,* 6*b* and 6*c* illustrate embodiments of a heat exchanger installed to a magnetron as a box shape in a cooling system of the lighting apparatus using microwave energy in accordance with the present invention. FIG. 7 is a sectional view of FIG. 6*a.*

As depicted in FIGS. 5*a,* 5*b* and 5*c,* a heat exchanger 61 for cooling the magnetron 31 constructed as a pipe and surrounds the exterior of the magnetron 31 as a coil.

In addition, as depicted in FIGS. 6*a,* 6*b,* 6*c* and 7, a heat exchanger 62 for cooling the magnetron 31 has a box shape and installed to the magnetron 31.

Figure 8:
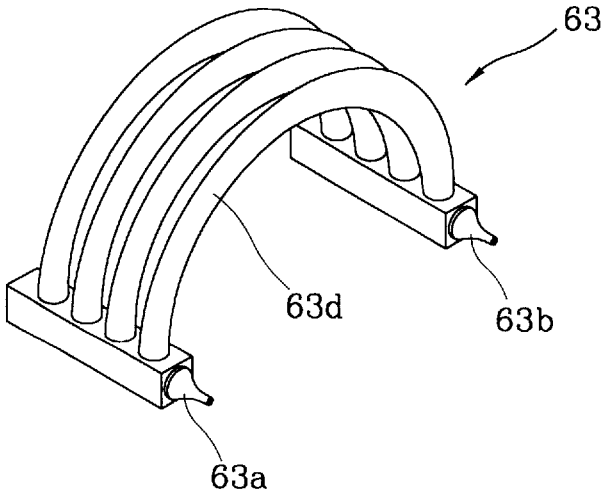
FIG. 8 illustrates an embodiment of a heat exchanger for cooling a wave guide of a cooling system of the lighting apparatus using microwave energy in accordance with the present invention.

FIG. 8 illustrates an embodiment of a heat exchanger for cooling a wave guide of a cooling system of the lighting apparatus using microwave energy in accordance with the present invention.

As depicted in FIG. 8, a heat exchanger 63 for cooling the wave guide 33 is constructed with an inlet hole 63*a* for an inflow of a coolant, an outlet hole 63*b* for discharging a coolant, and a plurality of coil-shaped pipes 63*d* installed to the exterior of the wave guide 33 in order to connect the inlet hole 63*a* and the outlet hole 63*b* as a coolant path. It is preferable to form the heat exchanger 62 for cooling the wave guide 33 as one body with the wave guide 33 and form a coolant path at the external wall of the wave guide 33.

Like a heat exchanger for cooling a magnetron or a wave guide, in the heat exchanger 60 for cooling the high voltage generator 32 or the condenser 34, a receiving portion for receiving a coil-shaped pipe or a high voltage generator or a condenser is formed, and a box-shaped heat exchanger having an internal coolant path is used.

And, as depicted in FIG. 2, in order to perform heat exchange more efficiently inside the casing 51 of the lighting apparatus using microwave energy, it is preferable to place a fan 52 for generating an air flow inside the casing 51.

Figure 9:
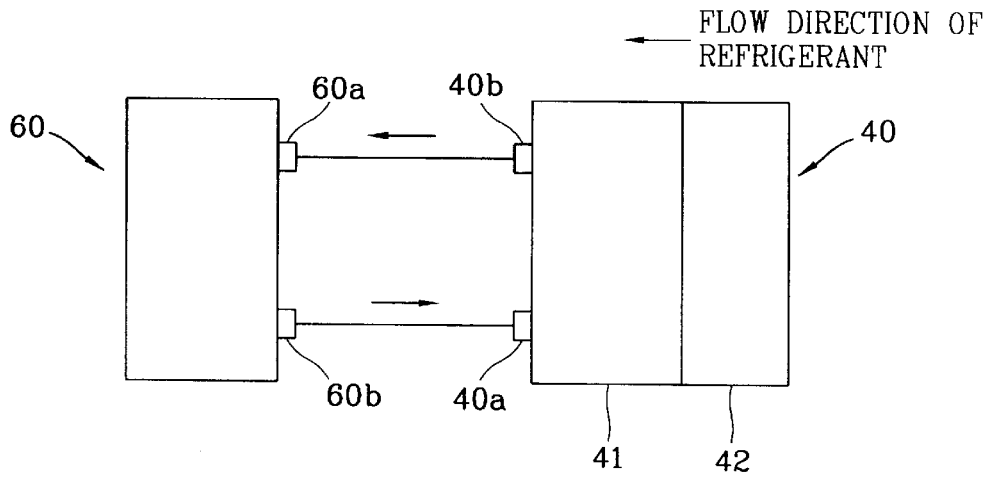
FIG. 9 is a perspective view illustrating the cooling system of the lighting apparatus using microwave energy in accordance with the present invention.

FIG. 9 is a perspective view illustrating a cooling system of the lighting apparatus using microwave energy in accordance with the present invention.

As depicted in FIG. 9, the radiating unit 40 is constructed with a radiator 41 having an inlet hole 40*a* connected to the outlet hole 60*b* of the heat exchanger 60 and an outlet hole 40*b* connected to the inlet hole 60*a* of the heat exchanger 60 and a cooling fan 42.

In addition, as depicted in FIG. 2, a pump, etc. can be used as the flow generating means 10*a*. The flow generating means 10*a* is installed between the outlet hole 40*b* of the radiating unit 40 and the inlet hole 60*a* of the heat exchanger 60 in order to make the coolant circulate the heat exchanger 60 and the radiating unit 40. Particularly, in order to adjust a quantity of circulating coolant, a coolant tank 20 can be installed between the outlet hole 40*b* of the radiating unit 40 and the flow generating means 10*a*.

Figure 10:
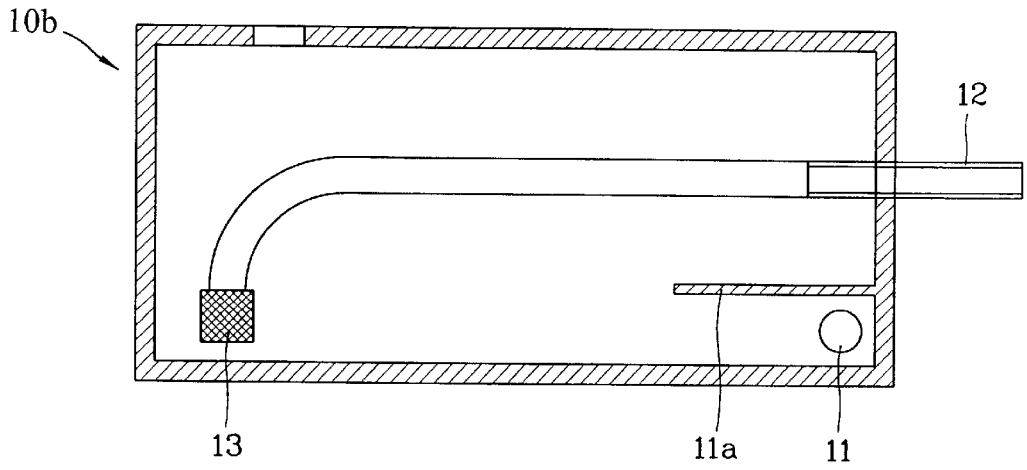
FIG. 10 is a sectional view illustrating an embodiment of a coolant tank of a cooling system of the lighting apparatus using microwave energy in accordance with the present invention.

FIG. 10 is a sectional view illustrating an embodiment of a coolant tank of a cooling system of the lighting apparatus using microwave energy in accordance with the present invention.

As depicted in FIG. 10, in the coolant tank 10*b* an inlet hole 11 for an inflow of the coolant from the radiator 41 is formed at the lower end portion in order to lower a whole temperature by mixing the coolant uniformly, and a cut-off unit 11*a* is installed at the upper portion. And, by installing a weight 13 to the end of the outlet hole 12 discharging the coolant from the coolant tank 10*b*, although an installation position of the coolant tank 10*b* is changed, the coolant can flow in.

In the meantime, in the casing 51 of the lighting apparatus using microwave energy, a hole for passing a connection pipe (not shown) connecting the heat exchanger 60 inside the casing 51 and the radiating unit 40 is formed, herein the outer circumference of the connection pipe and the casing is sealed up in order to seal the casing 51.

In addition, in order to construct the lighting apparatus compactly, the radiating unit 40, the coolant tank 10*b* and the flow generating means 10*b* installed at the exterior of the casing 51 of the lighting apparatus are placed inside a case 70 as modules.

Various coolants can be used for the cooling system, but it is preferable to use water as a coolant in consideration of a production cost, a cooling performance and a usage temperature.

In the meantime, the operation of the cooling system of the lighting apparatus using microwave energy in accordance with the present invention will be described in detail.

First, in the cooling system of the lighting apparatus using microwave energy in accordance with the present invention, the magnetron 31 generates microwave energy according to a power apply, the microwave energy generated in the magnetron 31 excites a luminous unit (not shown) of the bulb 50 through the wave guide 33, accordingly the luminous unit generates a light. According to the operation of the lighting apparatus, the internal heat generating units 30 such as the magnetron 31, the high voltage generator 32, the wave guide 33 and the condenser 34, etc. generate lots of heat.

In the meantime, when the lighting apparatus using microwave energy is operated, the cooling system installed to the lighting apparatus is operated simultaneously.

In more detail, the flow generating means 10*b* generates a flow of the coolant circulating the coolant path formed at the heat exchanger 60 installed to the internal heat generating units 30 and the radiating unit 40.

The circulating coolant absorbs heat generated at the internal heat generating units 30 while passing the coolant path formed at the heat exchanger 60 and radiates heat absorbed at the heat exchanger 60 outside while passing the radiating unit 40.

Accordingly, it is possible to radiate heat generated in the internal heat generating units 30 of the lighting apparatus outside stably even in a sealed state, accordingly the lighting apparatus can be efficiently operated without having damages of the internal units due to high heat.

As described above, because a lighting apparatus using microwave energy in accordance with the present invention has a sealed structure and a cooling system, it is possible to prevent impurities from penetrating into a casing, accordingly it can be used at outdoors and its life-span can be extended by preventing damage of internal construction parts due to external impurities and high heat.

At In addition, by improving a cooling efficiency, it is possible to increase its capacity and decrease its size.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. In a lighting apparatus using microwave energy including a magnetron for generating microwave energy, a bulb for generating lights by the microwave energy, a wave guide for connecting the magnetron and the bulb and transmitting the microwave energy generated in the magnetron to the bulb and a casing housing the magnetron and the wave guide and combining with the bulb, a cooling system of a lighting apparatus using microwave energy, comprising:

a heat exchanger installed to the exterior of a magnetron and having a coolant path;

a radiating unit installed to the exterior of a casing and radiating heat of the coolant heated while passing the coolant path of the heat exchanger; and a flow generating means installed between an outlet of the radiating unit and an inlet of the heat exchanger in order to make the coolant circulate the heat exchanger and the radiating unit.

2. The system of claim 1, wherein a coolant tank filled with a coolant is installed between the radiating unit and the flow generating means.

3. The system of claim 1, wherein the coolant is water.

4. The system of claim 1, wherein a heat exchanger is formed as one body with the exterior of the magnetron.

5. The system of claim 1, wherein a heat exchanger is additionally installed at the exterior of the wave guide.

6. The system of claim 1, further comprising:

a high voltage generator for supplying high voltage power in order to make the magnetron generate microwave energy; and a heat exchanger installed to the exterior of the high voltage generator.

7. The system of claim 1, further comprising:

a condenser; and a heat exchanger installed to the exterior of the condenser.

8. The system of claim 1, wherein the heat exchanger is a coil-shaped tube surrounding the exterior of the magnetron.

9. The system of claim 1, wherein the heat exchanger includes:

a body unit;

a receiving portion formed at the central portion of the body unit in order to receive the magnetron;

a coolant inlet hole formed at the side of the body unit for an inflow of a coolant;

a coolant outlet hole formed at the other side of the body unit for a discharge of the coolant; and a coolant path formed inside the body unit in order to connect the coolant inlet hole and the coolant outlet hole.

10. In a lighting apparatus using microwave energy including a magnetron for generating microwave energy, a bulb for generating lights by the microwave energy, a wave guide for connecting the magnetron and the bulb and transmitting the microwave energy generated in the magnetron to the bulb and a casing housing the magnetron and the wave guide and combining with the bulb, a cooling system of a lighting apparatus using microwave energy, comprising:

a heat exchanger installed to the exterior of internal heat generating units of the lighting apparatus and having a coolant path;

a radiating unit installed to the exterior of a casing and radiating heat of a coolant heated while passing the coolant path of the heat exchanger; and a flow generating means installed between an outlet of the radiating unit and an inlet of the heat exchanger in order to make the coolant circulate the heat exchanger and the radiating unit.

11. The system of claim 10, wherein the internal heat generating units are a magnetron, a wave guide and a high voltage generator.

12. The system of claim 10, wherein a condenser is additionally included in the internal heat generating units.

13. The system of claim 10, wherein the plurality of heat exchangers installed to the internal heat generating units are connected in series.

14. The system of claim 10, wherein the heat exchanger includes:

a body unit having a receiving portion for receiving the internal heat generating units and a plurality of coolant paths;

a coolant inlet hole formed at the end of the plurality of coolant paths for an inflow of a coolant; and a coolant outlet hole formed at the other end of the plurality of coolant paths for a discharge of the coolant.

15. The system of claim 10, wherein the casing of the lighting apparatus is sealed in order to prevent penetration of external impurities.

16. The system of claim 10, further comprising:

a fan placed inside the casing in order to generate an air flow.

* * * * *